US007970311B2

(12) United States Patent
Nakamura et al.

(10) Patent No.: US 7,970,311 B2
(45) Date of Patent: Jun. 28, 2011

(54) DEVELOPING DEVICE AND IMAGE FORMING APPARATUS USING THE SAME

(75) Inventors: Kenji Nakamura, Ibaraki (JP); Yuichiro Suzuki, Ibaraki (JP); Katsumi Kumada, Ibaraki (JP); Shoji Takeya, Ibaraki (JP); Chikara Hiraoka, Ibaraki (JP)

(73) Assignee: Ricoh Company, Ltd., Ohta-Ku, Tokyo (JP)

( * ) Notice: Subject to any disclaimer, the term of this patent is extended or adjusted under 35 U.S.C. 154(b) by 796 days.

(21) Appl. No.: 12/000,165

(22) Filed: Dec. 10, 2007

(65) Prior Publication Data

US 2008/0145094 A1 Jun. 19, 2008

(30) Foreign Application Priority Data

Dec. 13, 2006 (JP) ..... P2006-335321

(51) Int. Cl.
*G03G 15/08* (2006.01)

(52) U.S. Cl. ..... 399/109

(58) Field of Classification Search ..... 399/109
See application file for complete search history.

(56) References Cited

U.S. PATENT DOCUMENTS

| | | | | |
|---|---|---|---|---|
| 5,926,675 | A * | 7/1999 | Miyano et al. | 399/262 |
| 2006/0171737 | A1 * | 8/2006 | Nishimura et al. | 399/109 |

FOREIGN PATENT DOCUMENTS

| | | |
|---|---|---|
| JP | 63-106674 | 5/1988 |
| JP | 04-000475 | 1/1992 |
| JP | 2006-208837 | 8/2006 |

* cited by examiner

*Primary Examiner* — David M Gray
*Assistant Examiner* — Andrew V Do
(74) *Attorney, Agent, or Firm* — McGinn IP Law, PLLC

(57) ABSTRACT

According to an aspect of the present invention, there is provided a developing device including: a roller that develops an electric latent image formed on an image holding body; a chamber that stores a toner; a case that houses the roller and the chamber; a concave portion that is inwardly concaved from the case and that includes: a sidewall, a bottom, and a filling port formed in the bottom; and a first lid that closes the filling port.

17 Claims, 5 Drawing Sheets

DEVELOPING DEVICE AND IMAGE FORMING APPARATUS USING THE SAME

CROSS-REFERENCE TO RELATED APPLICATIONS

The entire disclosure of Japanese Patent Application No. 2006-335321 filed on Dec. 13, 2006 including specification, claims, drawings and abstract is incorporated herein by reference in its entirety.

BACKGROUND OF THE INVENTION

1. Field of the Invention

An aspect of the present invention relates to a developing device that can be recycled, and an image forming apparatus using the same.

2. Description of the Related Art

As an image forming apparatus including an optical device for condensing a laser beam onto a scanning surface and performing a straight line scanning, a laser printer has come into wide use. The laser printer exposes a light to a photosensitive body by an optical device, forms a latent image according to letters or image information, and visualizes it as a toner image by a developing device. Then, it transfers the image onto a recording paper by a transfer unit, and fixes it by a fixing unit. As a result, printing is carried out.

In such a laser printer, there is detachably mounted a cartridge type developing device to be exchanged with a new developing device after the toner previously filled in the developing device has been consumed. To the cartridge type developing device, a lid member for closing the filling port to filling a toner is attached. Since the lid member is detachable, even a developing device from which the toner has been consumed can be used as a recycled developing device by detaching the lid member and filling a toner therein again.

The developing device includes a sealing member that prevents a toner from leaking from the developing roller equipped in a developing device or the periphery of the developing roller to the outside. The life of the sealing member is set at, for example, 3 times or less in terms of the filling frequency of a toner. For the recycled developing device, the discrimination from a new developing device or the identification of the filling frequency of a toner is difficult. For this reason, the filling frequency of a toner can not be identified with reliability. Therefore, for every developing device refilled with a toner, the fatigue degree of each component must be checked.

In order to solve the problem, there is proposed a developing device for which the discrimination between the recycled developing device and a new developing device is carried out by displaying and welding the replenishing frequency on a lid material closing a toner filling port (see, e.g., JP-A-4-475).

Also, there is proposed a developing device which has a cylindrical part protruding from the rim of a filling port disposed at the outer wall of a developing case to the outside. In the developing device, the outer edge of the cylindrical part and the lid member are welded. When a toner is refilled therein, the lid member is removed together with the cylindrical part. After refilling a toner, the refilling port is sealed with a refilling port lid member (see, e.g., JP-A-2006-208837)

However, with the technology of JP-A-4-475, the developing case and the lid member are welded. Therefore, the lid member is required to be forcedly detached. Thus, the refilling of a toner is difficult. Further, even when the lid member is detached, the trace of welding remains, which makes it difficult to attach a new lid member.

Also, with the technology of JP-A-2006-208837, the attachment part of the lid member protrudes from the rim of the toner filling port of the developing case to the outside. Therefore, in order to prevent the contact with the protruding part, the image forming apparatus is required to have a clearance part. In other words, the image forming apparatus is required to have a needless space at a position in the vicinity of the toner filling port of the developing device. When a plurality of developing devices are of such a movable type as to repeat contact and withdrawal with respect to a photosensitive body like a color laser printer, the image forming apparatus is further required to have a useless space at a position in the vicinity of the toner filling port of each developing device according to the direction of operation of the developing device.

SUMMARY OF THE INVENTION

It is an object of the present invention to provide a developing device capable of refilling a toner without forcedly detaching a lid member welded on a developing case, not requiring a useless space at a position in the vicinity of a toner filling port of the developing device in the image forming apparatus, and enabling easy discrimination between a recycled developing device in which a toner has been refilled and a new developing device, and an image forming apparatus using the same.

According to an aspect of the present invention, there is provided a developing device including: a roller that develops an electric latent image formed on an image holding body; a chamber that stores a toner; a case that houses the roller and the chamber; a concave portion that is inwardly concaved from the case and that includes: a sidewall, a bottom, and a filling port formed in the bottom; and a first lid that closes the filling port.

The toner may be filled into the chamber through the filling port.

The first lid may include: a first insertion part formed so as to fit in the filling port, and a first flange part formed so as to be in contact with the bottom.

The first flange part may be welded to the bottom.

The developing device may further include: a second lid that is formed on the first lid. The first lid may include a first hole formed therethrough. The second lid may close the first hole.

The toner may be filled into the chamber through the first hole and the filling port.

The first lid may be formed in a bottomed cylinder shape having a flange part.

The concave portion may be formed in a cylindrical shape. The first flange part may be formed in a circular shape.

The first lid may include a notch on the first flange part. The second lid may include a projection formed so as to fit in the notch.

The first lid may include a rib on the first flange part.

The rib may have a cross shape.

The developing device may further include a plurality of lids formed on the first lid.

A total height of the first lid and the plurality of the lids may be smaller than a height of the sidewall from the bottom.

The case may be made repeatedly usable until a total height of the first lid and the plurality of lids becomes larger than a height of the sidewall from the bottom.

The case may include: an upper case, and a lower case. The upper case and the lower case may be welded with each other.

According to another aspect of the present invention, there is provided a method for filling a toner in a developing device that includes: a chamber into which the toner is filled; a case that houses the chamber; and a concave portion that is inwardly concaved from the case and that includes: a sidewall, and a bottom; the method including: forming a filling port on the bottom; filling the toner into the chamber through the filling port; and closing the first hole by forming a first lid on the bottom.

The method may further includes: forming a first hole in the first lid; filling the toner into the chamber through the first hole and the filling port; and closing the first hole by forming a second lid on the first lid.

The step of closing may include: forming the first lid so as to have a gap between the first lid and the sidewall; welding the first lid so as to fill the gap by a resin that forms the first lid.

According to another aspect of the present invention, there is provided an image forming apparatus including the development device.

BRIEF DESCRIPTION OF THE DRAWINGS

Embodiments of the present invention will be described in detail based on the following figures, wherein.

DETAILED DESCRIPTION OF THE INVENTION

In the present invention, an inwardly concave tube part is disposed in the developing case. A toner filling port is formed in a tube bottom part of the tube part. A flange part of a lid member for closing the toner filling port is welded and bonded on the tube bottom part. As a result, the trace of the originally attached lid member remains on the recycled developing device when the lid member has been detached therefrom. Also, a different lid member from the originally attached lid member is attached. This enables discrimination between the recycled developing device and a new developing device.

When a toner is refilled, a hole is opened in the first lid member welded for closing the toner filling port, and a toner is refilled through the hole. Then, a second lid member is stacked and welded on the first lid member. As a result, the device can be used as a recycled developing device. By confirming the number or height of the lid members, the recycled developing device and a new developing device can be discriminated. Further, the toner filling port is formed in the tube bottom part of the developing case. After refilling a toner, lid members can be stacked and welded one on another inside the tube part. Since the lid members do not protrude outward the developing case, a useless space is not required at a position in the vicinity of the toner filling port of the developing device in the image forming apparatus, which enables recycling of the developing device.

Below, embodiments will be described in details by reference to the accompanying drawings.

First Embodiment

First, by reference to FIG. 4, a description will be given to the configuration of a color image forming apparatus.

Figure 4:
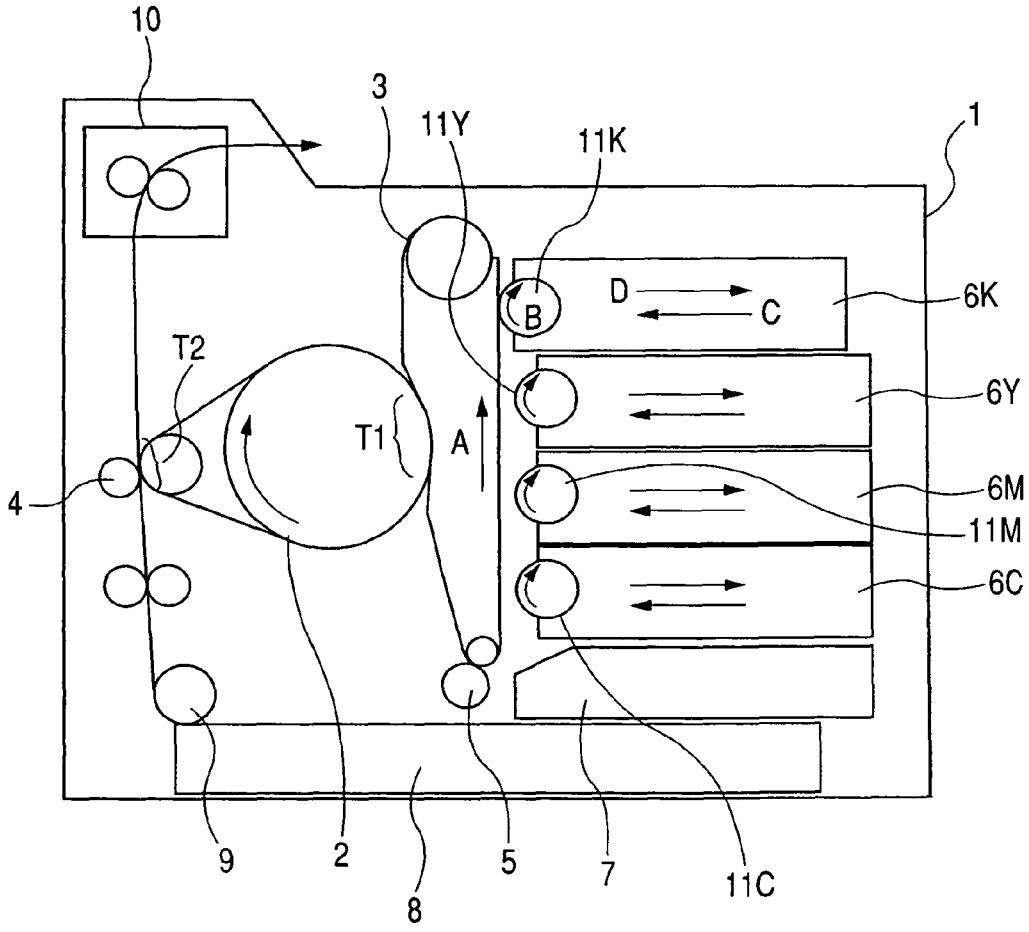
FIG. 4 is a schematic configuration view of a color image forming apparatus according to the embodiment.

FIG. 4 is a schematic configuration view of the color image forming apparatus including a developing device according to the embodiments.

A color image forming apparatus 1 is a color laser printer capable of forming a color image by rotating an intermediate transfer body 2 four turns, and superimposing four color images one on another.

Below, each unit in the inside of the color image forming apparatus 1 will be described.

At the central part of the color image forming apparatus 1, the intermediate transfer body 2 is disposed. In the periphery of the intermediate transfer body 2, a photosensitive body 3 and a transfer device 4 are disposed. In the periphery of the photosensitive body 3, a charging unit 5 is disposed. There are disposed, in a stacked form, developing devices 6K, 6Y, 6M, and 6C respectively including four different color toners sealed therein, and having developing rollers 11K, 11Y, 11M, and 1C, each rotating in contact with the photosensitive body 3, respectively. It is configured so that the developing devices 6K, 6Y, 6M, and 6C are movable along the direction indicated with arrows C and D in the drawing. Thereby, the developing devices 6K, 6Y, 6M, and 6C each come in contact with the photosensitive body 3, or retreat toward the front side of the color image forming apparatus 1. Under the developing device 6C, an optical device 7 is disposed. Thereunder, there are further disposed a Paper holder 8 that stores paper sheets, and a paper feed device 9. In the upper part of the color image forming apparatus 1, and above a transfer device 4, a fixing device 10 is disposed. Herein, the photosensitive body 3 may be in the form of a drum. The intermediate transfer body 2 may be in the form of a belt. The charging unit 5 may be of either contact or non-contact type. Two or more charging units may be disposed. The transfer device 4 may be either in the form of a roller or in the form of a belt.

The operation and process of each unit will be described. The photosensitive body 3 rotates in the direction of an arrow A in the drawing, and the surface thereof is uniformly charged by the charging unit 5.

Based on information such as images and characters input from an image scanner or the like, the optical device 7 exposes light on a dot by dot basis, and thereby forms an electrostatic latent image on the surface of the photosensitive body 3. Thereafter, the developing device 6K is moved in a direction of the arrow C in the drawing by a solenoid or a cam mechanism not shown. As a result, the developing roller 11K comes in contact with the photosensitive body 3. Thus, the developing roller 11K is rotatably driven in a direction of the arrow B in the drawing with a driving device not shown, so that a toner image is developed onto the photosensitive body 3. The toner image developed on the photosensitive body 3 is transferred onto the surface of the intermediate transfer body 2 at a first transfer part T1. Then, the developing roller 11K stops rotating, and then the developing device 6K retreats in the direction of the arrow D in the drawing. The step is repeated a required number of times by respective developing devices 6K to 6C. As a result, on the surface of the intermediate transfer body 2, a toner image corresponds to the information, such as images and characters, is formed. Then, the toner image is transferred onto a paper sheet fed from the Paper holder 8 by the paper feed device 9 at a second transfer position T2 with the transfer device 4. The paper sheet onto which the toner image has been transferred is transported to the fixing device 10, where the toner image is fixed on the paper sheet. Then, the paper sheet is ejected by a paper output device not shown.

The toner to be used has no particular restriction. In this embodiment, the toner particle diameter was set at 7.5 to 9.5 μm; the fine particle additive diameter, at 3 nm to 30 nm; and the bulk density, at 0.3 to 0.4 (g/cm$^3$).

The developing device 6K according to the embodiment will be described by reference to FIGS. 2 and 3. The same description also applies to the developing device 6Y, 6M, or 6C, and hence a description thereon will be omitted.

Figure 2:
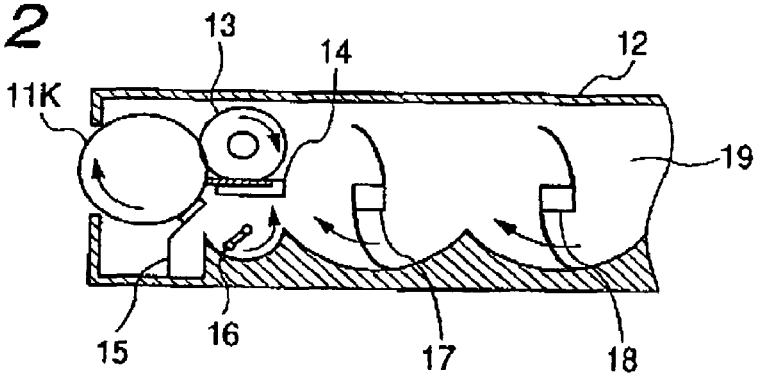
FIG. 2 is a schematic configuration view of the developing device according to the embodiment.

FIG. 2 is a schematic configuration view of the developing device 6K. FIG. 3 is a perspective view of the developing device 6K. The developing device 6K includes, as shown in FIG. 2, a developing case 12 in the form of a box opened at one end (on the left-hand side of the drawing), a developing roller 11K disposed in the developing case 12, for developing a toner image on the photosensitive body 3, a sponge roller 13, a stay member 14, a layer thickness regulating blade 15, and stirring paddles 16, 17, and 18.

Figure 3:
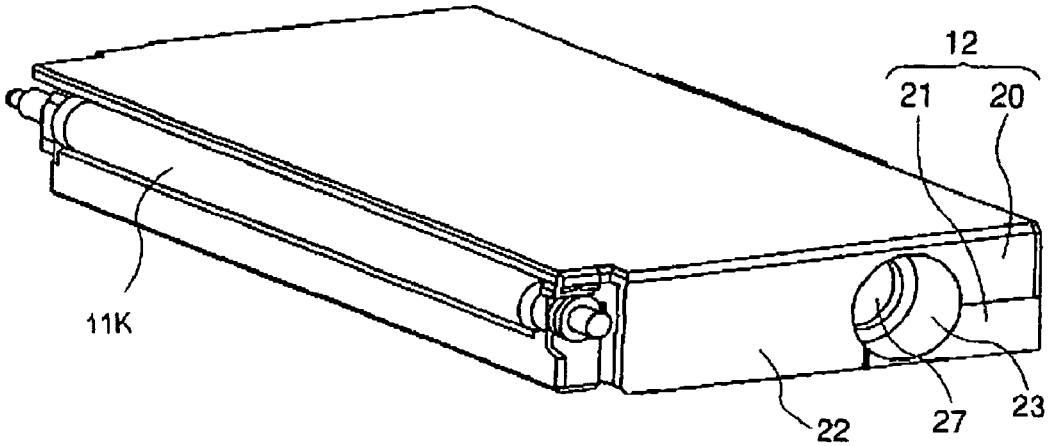
FIG. 3 is a schematic perspective view of the developing device according to the embodiment.

The developing case 12 includes, as shown in FIG. 3, a developing upper case 20 and a developing lower case 21, disposed vertically. The developing upper case 20 and the developing lower case 21 are bonded to each other by welding. In the state where the cases 20 and 21 are divided, internal components are mounted therein. Thereafter, the upper and lower cases 20 and 21 are welded. In this embodiment, a vertically divided type is superior in assemblability of components to be mounted in the inside thereof to an integral type or a horizontally divided type thereof. Since the developing device of the embodiment includes the components held by the sidewalls on the opposite sides, the horizontally divided type in which the case is divided at horizontal sides is difficult to assemble. Also, the integral type case requires an expensive mold, resulting in a high component unit price. Ultrasonic welding may be used because it requires only a lower manufacturing cost than with bonding by thermal welding or an adhesive.

At the sidewall 22 on the left side in the direction of the photosensitive body 3 of the developing case 12, there is formed a cylindrical part 23 including a cylindrical side part 24 and a cylindrical bottom part 25 (see, FIGS. 1A and 1B, for both), being concave inwardly of the developing case 12. At the cylindrical bottom part 25, there is disposed a toner filling port 26 (see, FIGS. 1A and 1B) for filling a toner into a toner storage chamber 19. The toner filling port 26 is closed with a first lid member 27 as a closing member for preventing the toner in the toner storage chamber 19 from leaking through the toner filling port 26.

Figure 1A:
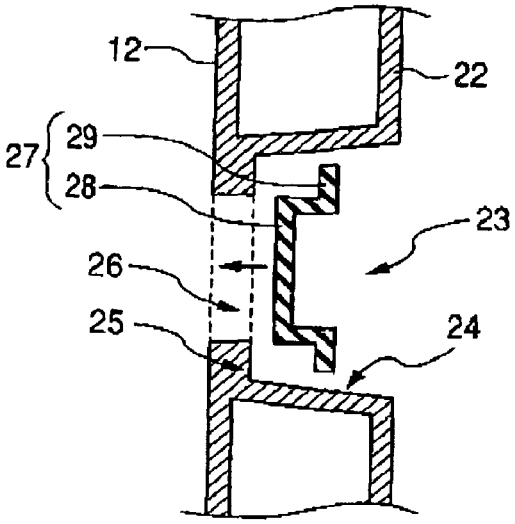
FIGS. 1A and 1B are cross sectional views each showing a developing device (the vicinity of a toner filling port) according to the embodiment.
Figure 1B:
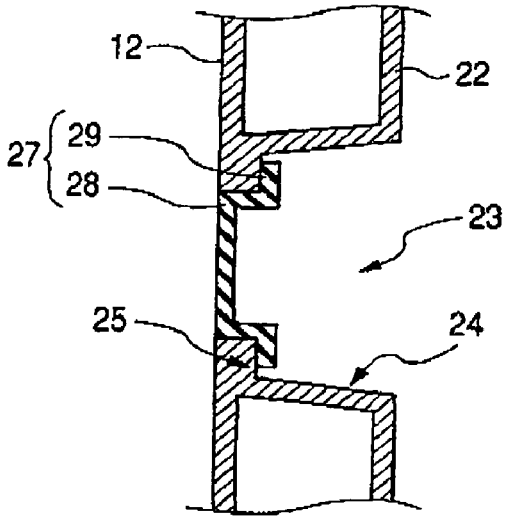

FIGS. 1A and 1B, and FIGS. 5A to 5C are each a cross sectional view showing the relationship between the toner filling port 26 and the first lid member 27 according to the first embodiment. The developing device 6K has the cylindrical part 23 being concave inwardly of the developing case 12 formed in a sidewall 22 on the left side of the developing case 12. In the cylindrical bottom part 25 that is the bottom of the cylindrical part 23, the toner filling port 26 is formed. The first lid member 27 has an insertion part 28 to be inserted into the toner filling port 26 for alignment, and a flange part 29 to come in contact with the cylindrical bottom part 25. After filling a toner in a new developing device 6K as shown in FIG. 1A, the first lid member 27 is inserted in the toner filling port 26. After inserting the first lid member 27, as shown in FIG. 1B, the flange part 29 of the first lid member 27 and the cylindrical bottom part 25 of the developing case 12 are melt and welded around the entire circumferences thereof. The first lid member 27 is bonded to the cylindrical bottom part 25 by welding, and hence it cannot be easily detached.

Figure 5A:
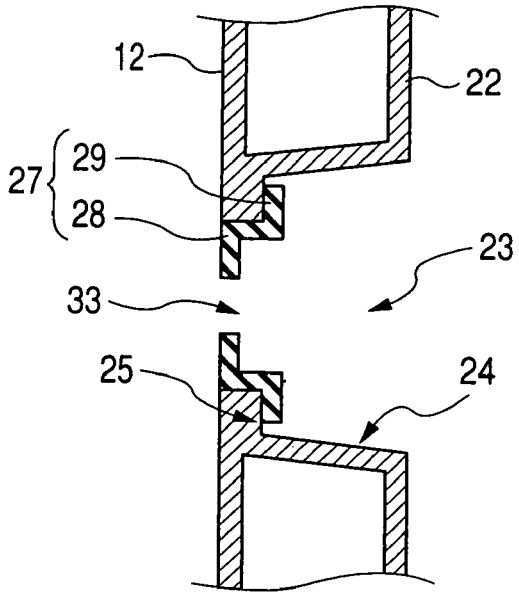
FIGS. 5A to 5C are cross sectional views each showing the developing device (the vicinity of a toner filling port) according to the embodiment.
Figure 5B:
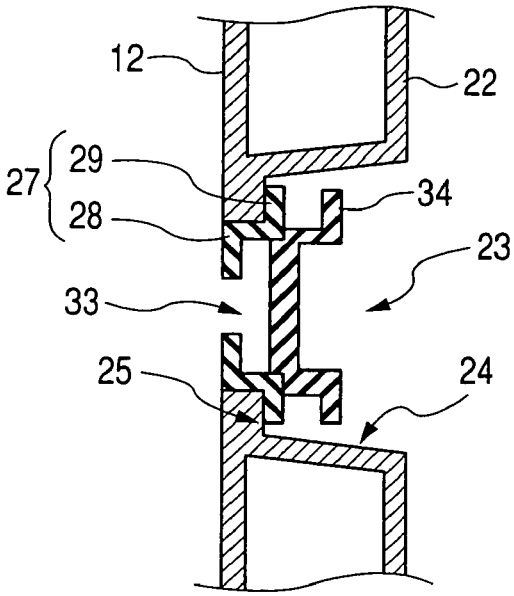
Figure 5C:
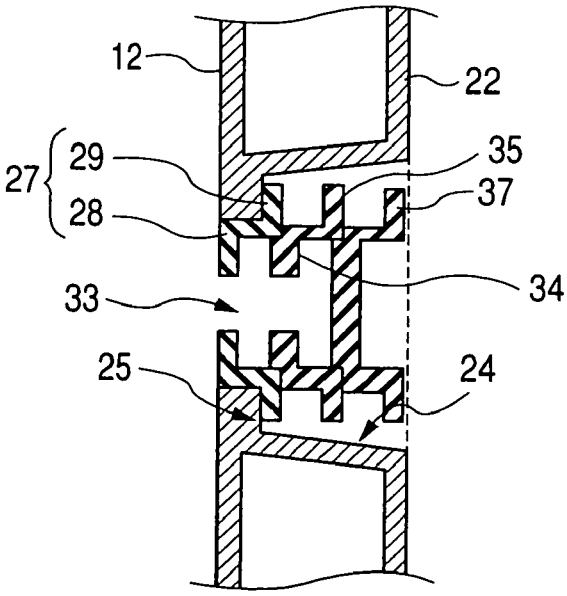

To refill a toner from this state, as shown in FIG. 5A, a hole 33 is opened in the first lid member 27 by post processing such as drilling. Thus, a toner is refilled therethrough. After refilling the toner, as shown in FIG. 5B, a second lid member 34 is stacked and welded on the flange part 29 of the first lid member 27. When a toner is further refilled in the developing device 6K in which a toner has been refilled, as shown in FIG. 5C, a hole is opened in the second lid member 34, and the hole 33 is exposed. Thus, a toner is filled therein, and a third lid member 37 is welded on a flange part 35 of the second lid member 34. As a result, the developing device 6K can be recycled.

The shape of each lid member is not particularly restricted. However, when the developing device 6K is recycled by using the same welding device as with the new product, and putting a lid thereon, the flange part 29 of the first lid member 27 may have the same or similar shape as that of the flange part 35 of the second lid member 34. Also, the third lid member 37 may have a different shape from that of the second lid member 34.

As described above, in the cylindrical bottom part 25 of the cylindrical part 23 having an inwardly concave shape in the developing case 12, the toner filling port 26 for filling a toner in the toner storage chamber 19 is disposed. As a result, the lid members can be stacked and welded one on another up to the height of the sidewall 22 of the developing case 12. The lid member does not protrude outwardly from the developing case 12. Therefore, the color image forming apparatus 1 is not required to have a useless space at a position in the vicinity of the toner filling port 26 of the developing device 6K. Also, by confirming the number or the height of the lid members, it is possible to identify the toner filling frequency.

For the welding in this embodiment, ultrasonic welding was used. However, any fixing method, such as a method using adhesion by a solvent or thermal welding, can be adopted so long as it can prevent toner leakage. For the material of the developing case 12 and the first lid member 27, HIPS (high impact polystyrene) was used. However, a material suitable for welding such as ABS (acrylonitrile butadiene styrene) may also be used. It is preferable that the materials of the developing case 12, the first lid member 27, and the like are the same. This is because welding thereof is easy to perform. For example, the first lid member 27 with an outer diameter 29/inner diameter 25, and a thickness of 1.5 mm are used. For the welding device, there are employed a piezoelectric element type vibrator (PZT Langevin type bolted hone integral type) as a vibrator, a generator with phase feedback as an oscillator (PLL automatic tracking type) as an oscillator, a frequency of 23.5±1.5 kHz, an amplitude of 25±2.5 μm, a booster magnification of 5.4 times, and the hone material SUS are used. The applied pressure is 10 to 20 kgf.

In the embodiment, the inwardly concave cylindrical part 23 disposed in the sidewall of the developing case 12. However, the inwardly concave cylindrical part 23 may be disposed in other sides, such as the upper side or the lower side.

Second Embodiment

A second embodiment will be described by reference to FIGS. 6A to 6C, 7, and 8A to 8D.

The developing device 6K will be described. The same description also applies to the developing devices 6Y, 6M, and 6C, and hence a description thereon will be omitted.

Figure 6A:
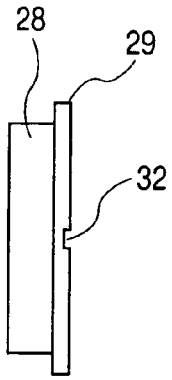
FIGS. 6A to 6C are schematic views each showing the shape of a first lid member of the developing device according to the embodiment.
Figure 6B:
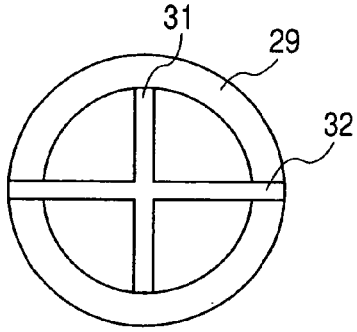
Figure 6C:
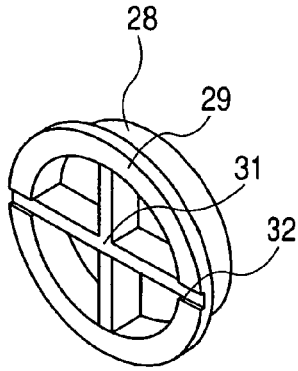
Figure 8A:
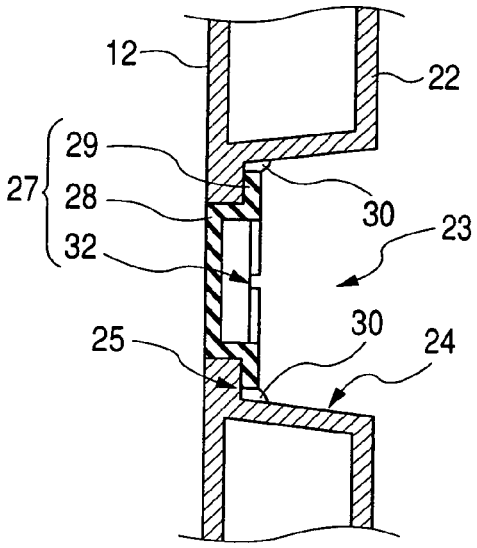
FIGS. 8A to 8D are cross sectional views each showing the developing device (the vicinity of a toner filling port) according to the embodiment.

FIGS. 6A to 6C are each a schematic view showing the shape of the first lid member 27 for closing the toner filling port 26. The first lid member 27 is in the shape of a bottomed cylindrical shape and has an insertion part 28 and a flange part 29. In the insertion part 28, a cross-shaped rib 31 is formed. In the flange part 29, a notch part 32 is formed on the side of the surface not in contact with the cylindrical bottom part 25 of the developing case 12. After filling a toner in a new developing device 6K, as shown in FIG. 8A, the insertion part 28 of the first lid member 27 is inserted in the toner filling port 26. Then, the cylindrical bottom part 25 of the developing case 12 and the flange part 29 of the first lid member 27 are fixed by welding. Upon welding, the strength of the first lid member 27 is enhanced by the rib 31 of the first lid member 27. This suppresses the distortion or deformation of the flange part 29 of the first lid member 27, which prevents the welding of the flange part 29 from becoming nonuniform. The rib 31 is a reinforcing rib for uniformly carrying out welding on the bottom of the cylindrical part.

Thus, the flange part 29 is uniformly welded on the cylindrical bottom part 25 of the developing case 12. Therefore, the resin 30 resulting from melting of a part of the flange part 29 of the first lid member 27 by welding is in such a state as to fill in the gap between the cylindrical side part 24 of the developing case 12 and the flange part 29 of the first lid member 27. Thus, the sealing property between the cylindrical bottom part 25 of the developing case 12 and the first lid member 27 is improved.

Figure 7:
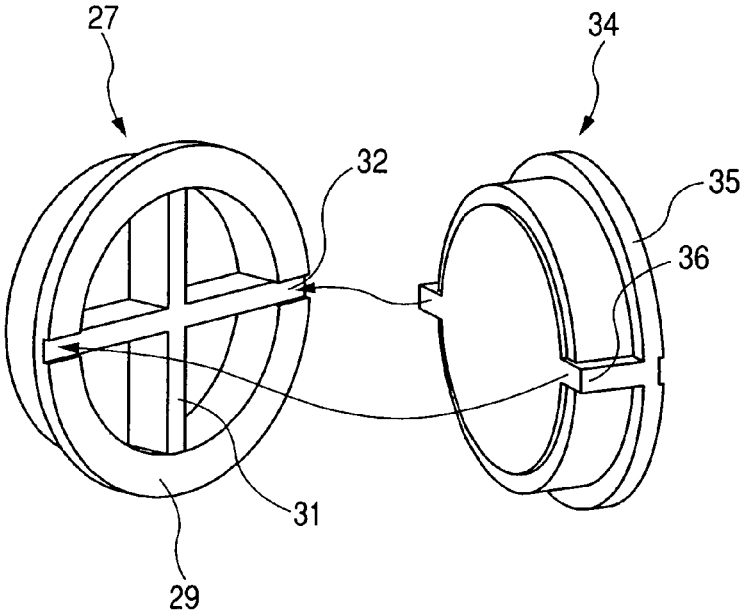
FIG. 7 is a schematic view showing the positional relationship between the first lid member and a second lid member of the developing device according to the embodiment.
Figure 8B:
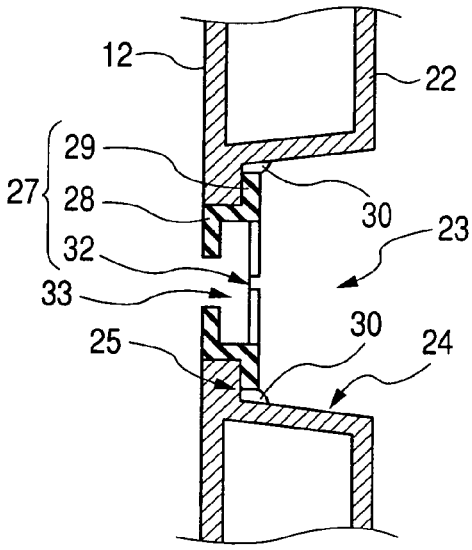
Figure 8C:
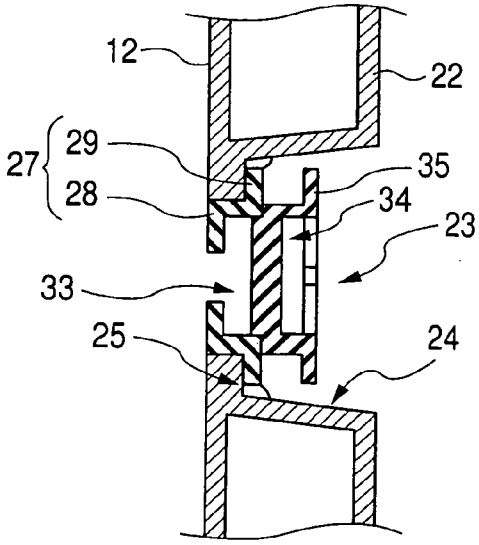
Figure 8D:
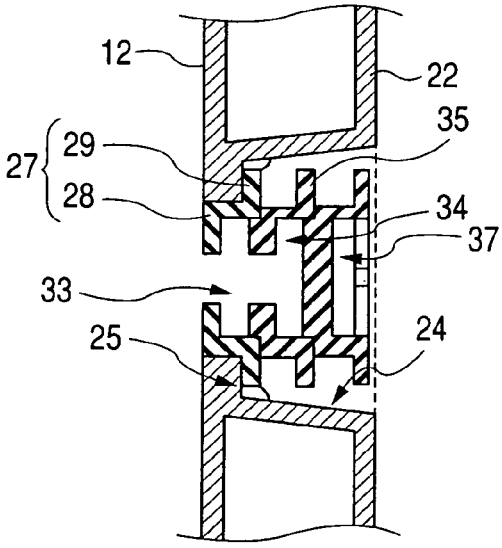

To refilled a toner, as shown in FIG. 8B, a hole 33 is opened in the first lid member 27 by post processing such as drilling. Thus, a toner is refilled therein. After refilling the toner, as shown in FIG. 8C, a second lid member 34 is stacked and welded on the flange part 29 of the first lid member 27. At this step, as shown in FIG. 7, an alignment part 36 of the second lid member 34 is aligned with the notch part 32 disposed in the flange part 29 of the first lid member 34, so that the position of the second lid member 34 is fixed. As a result, the second lid member 34 does not deviate during welding. Therefore, it is possible to ensure the sealing property between the first lid member 27 and the second lid member 34. By using the same configuration, as shown in FIG. 8D, when a hole is opened in the second lid member 34, a toner is filled therein, and the third lid member 37 is welded on the flange part 35 of the lid member 34, it is possible to ensure the sealing property between the second lid member 34 and the third lid member 37.

The invention is not limited to the foregoing embodiments. For example, the rib disposed on the lid member is not required to be in the form of a cross. Any notch part is acceptable so long as it has such a shape as to carry out alignment with the second lid member. Also, any lid member is acceptable so long as it has a flange part and a convex part, and can prevent toner leakage. It is not necessarily required to have a cylindrical shape.

According to an aspect of the present invention, there is provided a developing device not protruding outwardly of the developing device and not requiring a useless space at a position in the vicinity of a toner filling port, and an image forming apparatus.

What is claimed is:

1. A developing device comprising:

a roller that develops an electric latent image formed on an image holding body;

a chamber that stores a toner;

a case that houses the roller and the chamber;

a concave portion that is inwardly concaved from the case and that comprises:

a sidewall;

a bottom; and a filling port formed in the bottom;

a first lid that closes the filling port, the first lid comprising:

a first insertion part formed so as to fit in the filling port; and a first flange part formed so as to be in contact with the bottom, wherein the first lid includes a notch on the first flange part; and a second lid which includes a projection formed so as to fit in the notch.

2. The developing device according to claim 1, wherein the toner is filled into the chamber through the filling port.

3. The developing device according to claim 1, wherein the first flange part is welded to the bottom.

4. The developing device according to claim 1, wherein the second lid attached to the first lid, wherein the first lid comprises a first hole formed therethrough, and wherein the second lid closes the first hole.

5. The developing device according to claim 4, wherein the toner is filled into the chamber through the first hole and the filling port.

6. The developing device according to claim 1, wherein the first lid is formed in a bottomed cylinder shape including a flange part.

7. The developing device according to claim 1, wherein the concave portion is formed in a cylindrical shape, and wherein the first flange part is formed in a circular shape.

8. The developing device according to claim 1, wherein the first lid includes a rib on the first flange part.

9. The developing device according to claim 8, wherein the rib comprises a cross shape.

10. The developing device according to claim 1, further comprising a plurality of lids formed on the first lid.

11. The developing device according to claim 10, wherein a total height of the first lid and the plurality of the lids is less than a height of the sidewall from the bottom.

12. The developing device according to claim 10, wherein the first lid and the plurality of lids comprise heights such that a total height of the first lid and the plurality of lids becomes greater than a height of the sidewall from the bottom if the developing device should not be reused.

13. The developing device according to claim 1, wherein the case comprises:

an upper case; and a lower case, and wherein the upper case and the lower case are welded with each other.

14. An image forming apparatus comprising the developing device according to claim 1.

15. A method for filling a toner in a developing device that comprises a chamber into which the toner is filled, a case that houses the chamber, and a concave portion that is inwardly concaved from the case and that comprises a sidewall, and a bottom; the method comprising:

forming a filling port on the bottom;

filling the toner into the chamber through the filling port; and closing the filling port by disposing a first lid on the bottom, the first lid comprising:

a first insertion part formed so as to fit in the filling port; and a first flange part formed so as to be in contact with the bottom, wherein the first lid is formed so as to include a notch on the first flange part to accommodate a second lid including a projection formed so as to fit in the notch.

16. The method according to claim 15 further comprising:

forming a first hole in the first lid;

filling the toner into the chamber through the first hole and the filling port; and closing the first hole by attaching the second lid to the first lid.

17. The method according to claim 15, wherein the closing the filling port comprises:

disposing the first lid so as to comprise a gap between the first lid and the sidewall;

welding the first lid so as to fill the gap with a resin that forms the first lid.

* * * * *